United States Patent [19]

Czaja

[11] Patent Number: 4,717,360

[45] Date of Patent: Jan. 5, 1988

[54] MODULAR ELECTRICAL CONNECTOR

[75] Inventor: Edwin E. Czaja, Mount Prospect, Ill.

[73] Assignee: Zenith Electronics Corporation, Glenview, Ill.

[21] Appl. No.: 840,628

[22] Filed: Mar. 17, 1986

[51] Int. Cl.[4] ..... H01R 9/00

[52] U.S. Cl. ..... 439/710

[58] Field of Search ..... 339/17 C, 59 M, 198 H, 339/198 G; 439/590, 594, 710

[56] References Cited

U.S. PATENT DOCUMENTS

| | | | |
|---|---|---|---|
| 2,396,725 | 3/1946 | Thomas, Jr. | 339/59 M |
| 3,582,863 | 6/1971 | Hoffman | 339/59 M |
| 3,950,056 | 4/1976 | Bowen | 339/59 M |
| 4,067,637 | 1/1978 | Narozny | 339/198 G |
| 4,230,387 | 10/1980 | Zahn | 339/59 M |
| 4,343,528 | 8/1982 | Lucius et al. | 339/198 G |
| 4,553,801 | 11/1985 | Zajeski | 339/59 M |

FOREIGN PATENT DOCUMENTS

| | | | |
|---|---|---|---|
| 123590 | 10/1984 | European Pat. Off. | 339/186 M |
| 2613704 | 10/1977 | Fed. Rep. of Germany | 339/186 M |

*Primary Examiner*—Gil Weidenfeld

*Assistant Examiner*—Daniel W. Howell

[57] ABSTRACT

A modular electrical connector including an elongate housing defining at least two laterally spaced, generally parallel rows of equally spaced contact supporting cavities. The cavities in each row are in longitudinal positions offset relative to the longitudinal positions of corresponding ones of the cavities in the opposite row. Equal numbers of cavities are provided in each row, and the break-away walls are located for separating the cavities into modules of varying numbers of sets of cavities with one cavity in each set being from each row. The break-away walls are located between adjacent cavities in each row, and rigid supporting walls extend laterally between each opposing cavity of each set. The cavities have common mating ends and conductor terminating ends, with the conductor terminating ends of all the cavities having access slots on one side of the connector for receiving conductors therethrough for termination to appropriate insulation displacement contacts supported in the cavities. Break-away polarizing posts are provided along the connector adjacent the mating ends of the contact supporting cavities.

8 Claims, 13 Drawing Figures

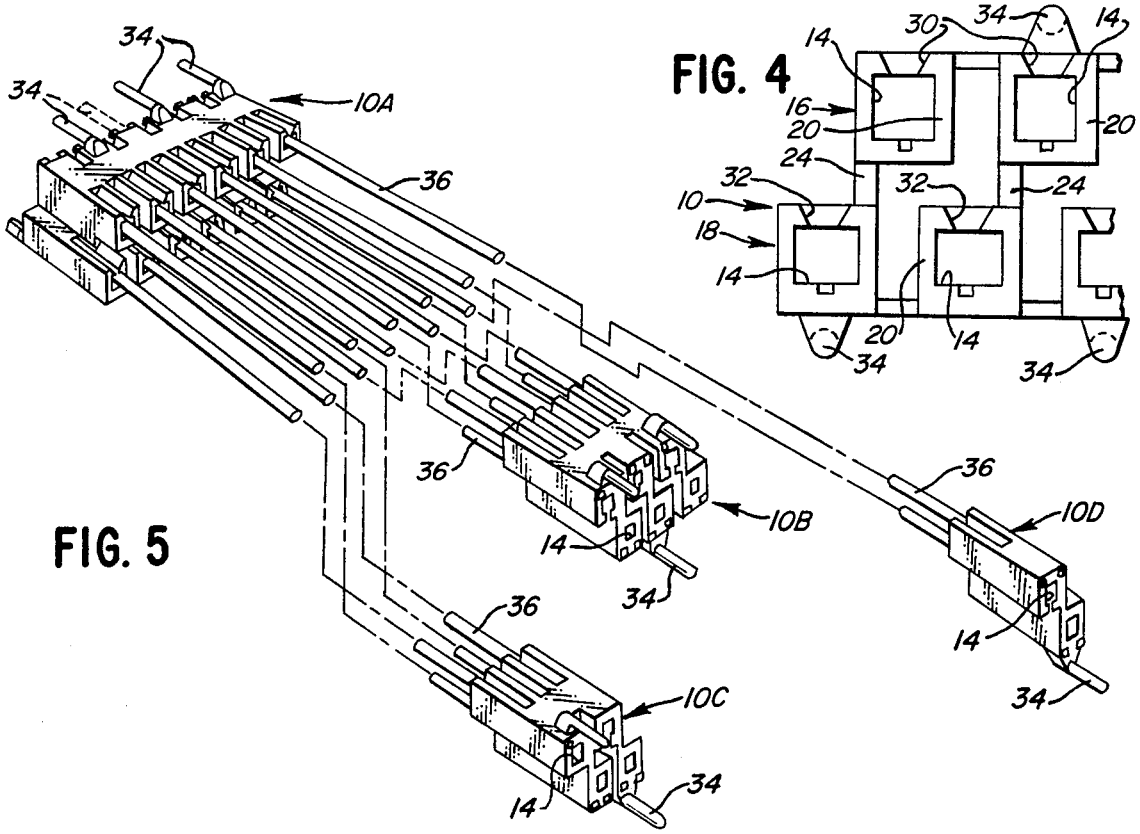
FIG. 5
FIG. 4
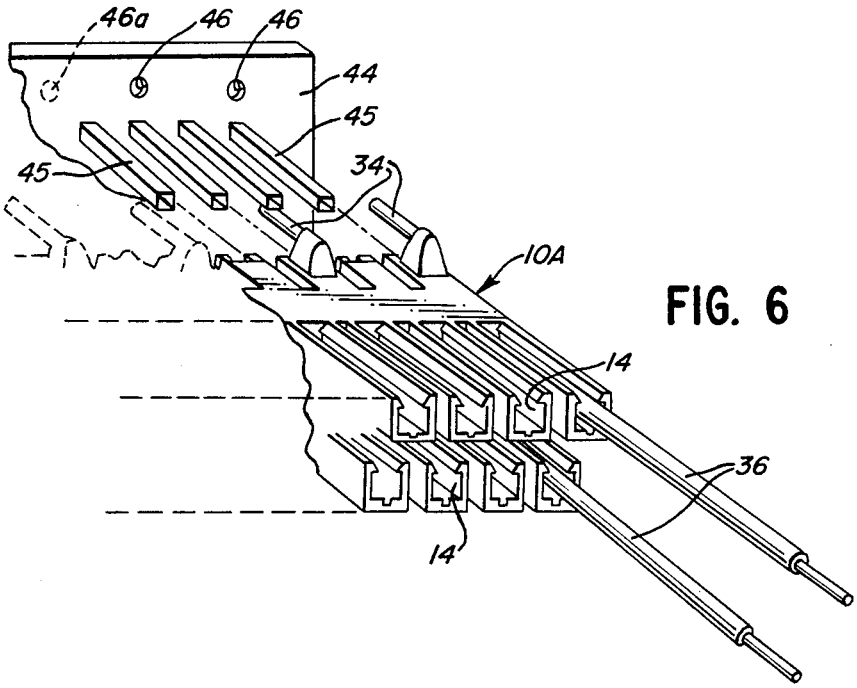
FIG. 6

MODULAR ELECTRICAL CONNECTOR

BACKGROUND OF THE INVENTION

This invention generally relates to electrical connectors and, particularly, to modular electrical connectors for use in connector harnesses which include individual connectors having different numbers of contacts for termination to printed circuit boards or the like.

Electrical connectors and termination machines have been designed for wiring connectors in harnesses with different sized connectors having different numbers of contacts and different lengths of wires. Fabrication of such harnesses is carried out by termination machines which, conventionally, are capable of terminating a given number of wires to appropriate connector contacts. For instance, and for purposes of illustration throughout this disclosure, a machine may have a "twenty-four position" termination head with the capability of terminating twelve pairs of wires to connectors having complementary contacts in multiples of twos. For instance, a twenty-four contact connector may be wired in a harness with three different connectors having twelve, eight and four contacts, respectively. Other combinations can be fabricated.

Heretofore, one method of terminating contacts in a harness, as described above, required that individual connectors be fabricated with the particular number of contacts in the different sized connectors. This was a very costly procedure because the termination machine had to be operated in plural terminating cycles and an inventory of the different sizes of connectors had to be maintained.

In order to solve the problems of wiring different size of individually terminated connectors in harnesses, a system was designed for fabricating connectors in "chains" with straps or webs joining a chain of connectors of different sizes whereby the connectors could be wired or terminated simultaneously. However, such systems could not use the termination machine to its maximum capacity or efficiency. In other words, if a twenty-four head termination machine is being used, wherever a strap or web is located between adjacent connectors, those termination positions of the machine head would be inoperative. An example would be in a situation where it might be desirable to wire a twelve contact connector to an eight contact connector and a four contact connector. This would be impossible in a twenty-four position head because the straps or webs which join the connectors would occupy certain of the wiring positions of the head. Therefore, any given harness requirement would result in one or more of the wiring positions of the head not being used. Such a system could not even wire two twelve contact connectors in a harness because the strap or web between the connectors would occupy one of the wiring positions of the head.

There is a need for a modular electrical connector for use in a system which will maximize the efficiency of termination machines and which will provide greater versatility in the numerical contact combinations affordable in connector wiring harnesses in a "one shot" termination machine.

OBJECTS OF THE INVENTION

Accordingly, an object of this invention is to provide a novel modular electrical connector.

Another object of the invention is to provide a modular electrical connector which is provided with break-away means between contact supporting cavities for forming connector modules of multiples of two contacts.

A further object of the invention is to provide a break-away modular electrical connector having offset contact supporting cavities in laterally spaced rows for separating the cavities into modules of varying numbers of sets of cavities with at least one cavity in each set being from each row of the connector.

Still another object of the invention is to provide a modular electrical connector of the character described and including novel polarizing means for use with printed circuit boards or the like.

BRIEF DESCRIPTION OF THE DRAWINGS

These and other objects of the invention will be apparent by reading the following description in conjunction with the drawings in which:

FIG. 4 is a fragmented plan view of the termination end of the connector;

FIG. 5 is a fragmented perspective view of a connector wiring harness incorporating different connector modules broken away from a single connector as illustrated in FIGS. 1–4;

FIG. 6 is a fragmented perspective view of a connector according to the invention, about to be terminated to a printed circuit board;

DESCRIPTION OF THE PREFERRED EMBODIMENT

Figure 1:
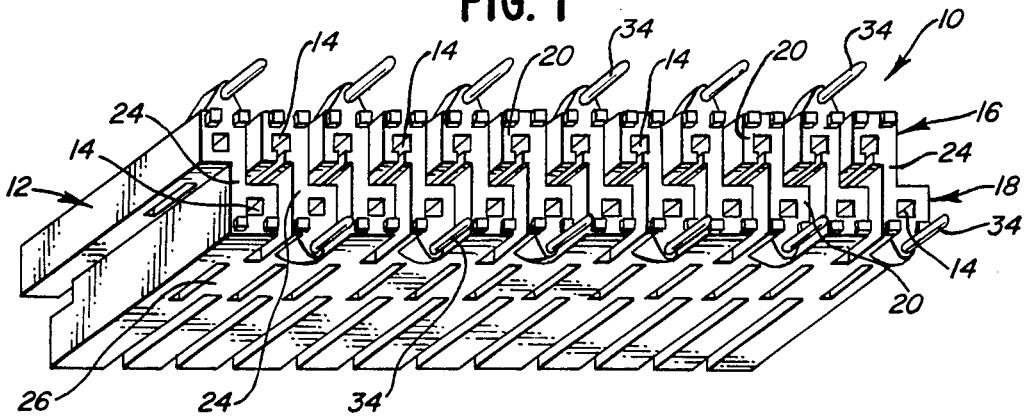
FIG. 1 is a perspective view looking at the mating end of a modular electrical connector according to the invention.
Figure 2:
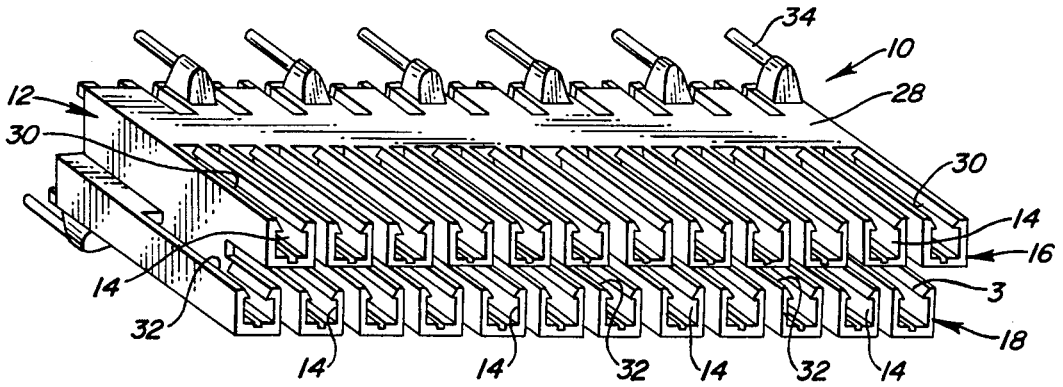
FIG. 2 is a perspective view looking at the termination end of the connector.

Referring to the drawings in greater detail, FIGS. 1–4 illustrate a modular electrical connector, generally designated 10, and incorporating the concepts of this invention. As stated above, one conventional termination machine includes a terminating head capable of wiring twentyfour wires to individual contacts in a "one shot" insulation displacement termination operation with a twenty-four head automatic tool. Consequently, the modular electrical connector 10 illustrated throughout the following description is designed for receiving twenty-four contacts for insulation displacement termination to twenty-four wires in a harness. However, it should be understood that other machines or automatic tool heads have different capabilities; namely, different numbers of terminating positions for wiring or terminating different numbers of wires to appropriate connectors.

Modular electric connector 10 is molded as a unitary structure, preferably of plastic, and includes an elongate housing, generally designated 12, defining at least two laterally spaced, generally parallel rows of contact receiving cavities 14. For purposes of illustration, one row of cavities is indicated generally by reference number 16 and the other row of cavities is generally designated by the reference number 18. It can be seen that the contact supporting cavities 14 in rows 16 and 18 are substantially closed by surrounding walls 20 at the mating end of the connector, as seen in FIGS. 1 and 3, and define substantially square openings for receiving terminal posts of a printed circuit board, as described hereinafter in reference to FIG. 6.

Figure 3:
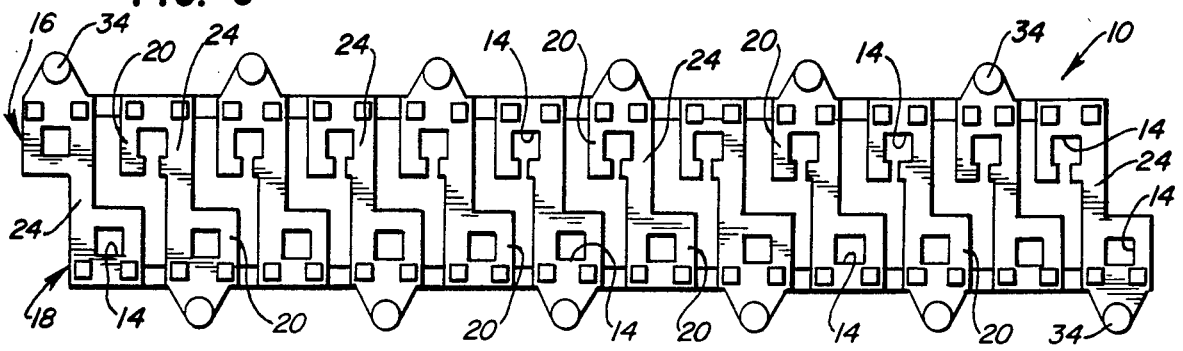
FIG. 3 is a plan view of the mating end of the connector.

As best seen in FIGS. 3 and 4, contact supporting cavities 14 in each row 16,18 are equally spaced and in longitudinal positions offset relative to the longitudinal positions of corresponding ones of the cavities in the opposite row. Supporting walls 24 laterally span the connector between and join opposing pairs of cavities 14 to divide connector 10 into a plurality of cavity sets lengthwise of the connector. In the embodiment illustrated in FIGS. 1–4, supporting walls 24 define rigid modules of multiples of two cavities.

Narrow break-away walls 26 and 28 (FIGS. 1 and 2) extend lengthwise along the entire connector on opposite sides thereof. These break-away walls initially interconnect each set of contact supporting cavities joined by supporting walls 24. As described in greater detail hereinafter with reference to FIG. 5, these break-away walls 26,28 provide for forming modules of contact supporting cavities 14 by the termination machine, including at least one offset cavity from each row 16,18.

Modular electrical connector 10 is designed for insulation displacement termination of appropriate contacts disposed within contact supporting cavities 14. More particularly, it can be seen in FIGS. 2 and 4 that contact supporting cavities 14 in row 16 are open or slotted, at 30, along a substantial length of the cavities whereby access means are provided on one side of connector 10 for receiving wires through slots 30 for termination to appropriate insulation displacement contacts (not shown) supported in the cavities. The contact supporting cavities in row 18 also are open or slotted, at 32, on the inside thereof and facing toward the same side of connector 10 that the cavities in row 16 are open. With the cavities in their longitudinal offset positions, access slots 32 are disposed in the gaps between the spaced cavities in row 16. Consequently, a termination machine can terminate all twenty-four wires or conductors to the insulation displacement contacts in all twenty-four contact supporting cavities 14 from one side of connector 10 in a "one shot" insulation displacement termination operation.

Another feature of the invention which is shown clearly in FIGS. 1 and 4 comprises a plurality of polarizing posts 34 along connector 10 adjacent the mating ends of at least one of the contact supporting cavities in each set of pair thereof from oppositing rows 16 and 18. In the embodiment illustrated, as best seen in FIGS. 3 and 4, the polarizing posts are staggered along the outer edges of connector 10, at the mating end thereof, with the posts alternating in position adjacent the contact supporting cavities of the opposing rows. Like break-away walls 26,28, polarizing posts 34 will be removed or broken away by the termination machine in its cycle of operation as programmed for a particular wiring harness and printed circuit board to which the connector is to be mated.

FIG. 5 shows a completed connector wiring harness fabricated from a twenty-four position terminating head of an automatic termination machine in a "one-shot" cycle of operation. The individual connectors are broken away from a twenty-four cavity connector 10 as described above in relation to FIGS. 1–4. The harness includes a twelve contact connector, generally designated 10A, at one end of the harness and terminated to six pairs of wires 36. The opposite end of the harness includes three individual connectors 10B, 10C and 10D, respectively, terminated to six, four and two wires, respectively, in three, two and one sets or pairs of multiples of two wires from connector 10A. Of course, a wide variety of harness configuration, including many different sized modules 10A–10D, can be fabricated from the single modular connector 10 (FIGS. 1–4), as will be apparent hereinafter in the description of FIGS. 7A–7F. The termination machine simply is programmed to break away walls 26,28 depending on the particular harness configuration.

It can be seen in FIG. 5 that the third polarizing post 34 (as viewed from the right) of module 10A has been removed by the termination machine. This is shown by the dotted lines. FIG. 6 illustrates connector 10A about to be mated with a printed circuit board 44 having apertures 46 for receiving polarizing posts 34. The printed circuit board may be a component of the electrical system of a television set, for instance. Square terminal posts 45 are received in contact supporting cavities 14 of the connector module. Apertures 46 are located in a predetermined pattern for receiving a given connector wired in accordance with the desired electrical circuitry. Specifically, it can be seen that board 44 does not include an aperture at the position indicated by dotted lines at **46*a*, whereby only connector modules polarized (by removing selected polarizing posts 46) such as module 10A can be mated with the board at that location. Of course, the termination machine is programmed for fabricating a wiring harness which would include a connector 10A for mating with the circuitry on board 44 at that particular position. Consequently, the machine simply will be programmed to break-away the connector to include a module of contacts and wires for mating with the board at that position, and polarizing posts 34 will be broken-away so that only properly positioned polarizing posts will remain for insertion into the pattern of apertures 46 at the intended position for that respective connector module. It can be seen that a single modular electrical connector 10 (FIGS. 1–4**) not only is terminated to the appropriate wires in a "one shot" cycle, but the connection is simultaneously customized to the appropriate size or multiples of contacts and polarized during a single cycle of operation.

Figure 7A:
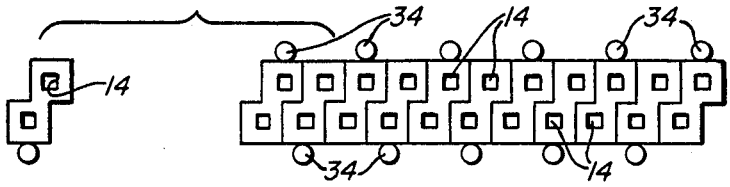
FIGS. 7A–7F are somewhat schematic illustrations of various numerical combination affordable with a twenty-four contact connector according to the invention, each connector configuration including one or more multiples of two contacts.
Figure 7B:
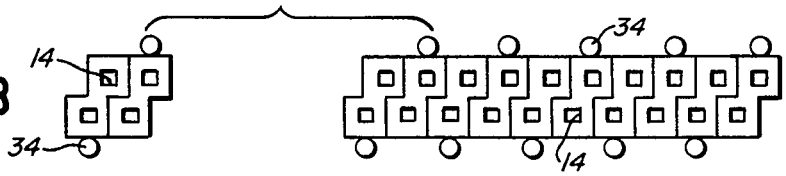
Figure 7C:
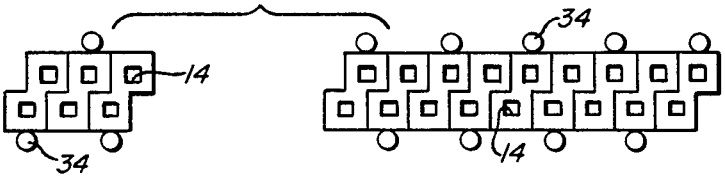
Figure 7D:
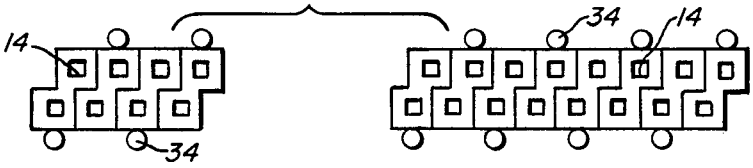
Figure 7E:
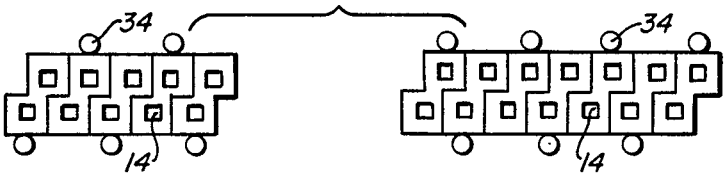
Figure 7F:
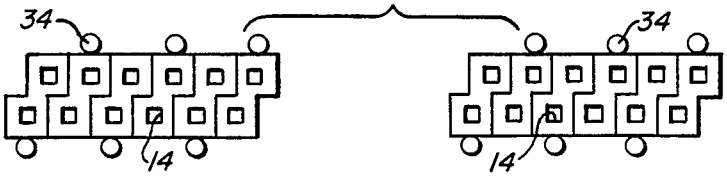

FIGS. 7A–7F schematically illustrate the manner in which a single twenty-four contact modular connector 10 can be formed into modules of different sizes or multiples of contacts. As seen, six different module combinations are illustrated as broken away from the one modular connector. FIG. 7A illustrates two modules of two and twenty-two contact receiving cavities, respectively. FIG. 7B shows two modules of four and twenty cavities, respectively. FIG. 7C shows two modules of six and eighteen cavities, respectively. FIG. 7D shows two modules of eight and sixteen cavities, respectively. FIG. 7E shows two modules of ten and fourteen cavities, respectively. FIG. 7F shows two modules of 12 cavities each, respectively. Of course, it is readily apparent that any one of the modules further can be divided for wiring in a harness as programmed complementary to the required circuitry. With the fabricating of a harness, as illustrated in FIG. 5, having opposite ends of various wiring bundles being terminated to respective connector modules, the numerical combinations afforded from a single modular connector 10, according to the invention, is enormous when considering that the harness is fabricated in a "one-shot" or single cycle of operation of the programmed termination machine. Furthermore, larger capacity machines can terminate and/or fabricate such modular connectors in greater numbers of cavities than a twenty-four position machine to further enlarge the numerical combinations available.

Figure 8:
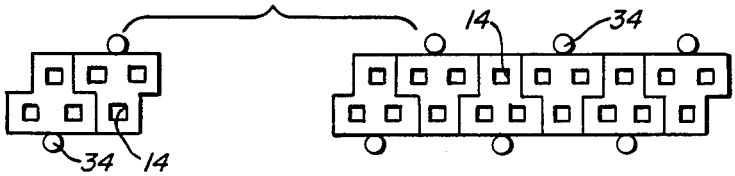
FIG. 8 is a schematic illustration similar to that of FIGS. 7A–7F, illustrating a modular connector configuration wherein the contacts are in multiples of three.

FIG. 8 schematically illustrates how the concepts of this invention can be employed to fabricate a modular connector wherein the offset contact supporting cavities can be utilized in an array of sets of contacts other than multiples of two. It can be seen that the contact sets in FIG. 8 are in multiples of three. This is accomplished by providing more rigid supporting wall means, such as walls 24 (FIGS. 3 and 4) between groupings of three cavities. In this manner, the termination machine would be designed to break away the modules at predetermined positions along break-away walls 26,28 to form different modules of multiples of three contact supporting cavities.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising an elongate housing defining at least two laterally spaced, generally parallel rows of equally spaced contact supporting cavities, the contact supporting cavities in each row being in longitudinal positions offset relative to the longitudinal positions of corresponding ones of the cavities in the opposite row, said contact supporting cavities having common mating ends and terminating ends, and the conductor terminating ends of all the cavities having access means on one side of the connector for receiving conductors therethrough for termination to appropriate insulation displacement contacts supported in the cavities.

2. The electrical connector of claim 1 wherein the access means to the cavities in the row on the side of the connector opposite said one side are disposed in gaps between the cavities in the row located at said one side.

3. A modular electrical connector, comprising an elongate housing defining at least two laterally spaced, generally parallel rows of equally spaced. contact supporting cavities with equal number of said contact receiving cavities being provided in each said rows, the contact supporting cavities in each row being in longitudinal positions offset relative to the longitudinal positions of corresponding ones of the cavities in the opposite row, and break-away wall means between corresponding offset cavities of opposing rows to provide for separating the cavities into modules of varying number of sets of cavities with one cavity in each set being from each row.

4. A modular electrical connector, comprising an elongate housing defining at least two laterally spaced, generally parallel rows of equally spaced contact supporting cavities, the contact supporting cavities in each row being in longitudinal positions offset relative to the longitudinal positions of corresponding ones of the cavities in the opposite row, break-away wall means between corresponding offset cavities of opposing rows to provide for forming modules of contact supporting cavities including at least one offset cavity from each row, supporting wall means between each opposing cavity of each said set thereof, and wherein said break-away wall means are located between adjacent cavities in each row.

5. A modular electrical connector, comprising an elongate housing defining at least two laterally spaced, generally parallel rows of equally spaced contact supporting cavities having common mating ends and conductor terminating ends, the conductor terminating ends of all the cavities having access means on one side of the connector for receiving conductors therethrough for termination to appropriate insulation displacement contacts supported in the cavities, the contact supporting cavities in each row being in longitudinal positions offset relative to the longitudinal positions of corresponding ones of the cavities in the opposite row, and break-away wall means between corresponding offset cavities of opposing rows to provide for forming modules of contact supporting cavities including at least one offset cavity from each row.

6. A modular electrical connector, comprising an elongate housing defining at least two laterally spaced, generally parallel rows of equally spaced contact supporting cavities having common mating ends and conductor terminating ends, the conductor terminating ends of all the cavities having access means on one side of the connector for receiving conductors therethrough for termination to appropriate insulation displacement contacts supported in the cavities, the access means to the cavities in the row on the side of the connector opposite said one side being disposed in gaps between the cavities in the row located at said one side, the contact supporting cavities in each row being in longitudinal positions offset relative to the longitudinal positions of corresponding ones of the cavities in the opposite row, and break-away wall means between corresponding offset cavities of opposing rows to provide for forming modules of contact supporting cavities including at least one offset cavity from each row.

7. A modular electrical connector, comprising an elongate housing defining at least two laterally spaced, generally parallel rows of equally spaced contact supporting cavities with equal numbers of said contact receiving cavities being provided in each said rows, and break-away wall means between at least some of the cavities of opposing rows to provide for separating the cavities into modules of varying numbers of sets of cavities with one cavity in each set being from each row.

8. A modular electrical connector, comprising an elongate housing defining at least two laterally spaced, generally parallel rows of equally spaced contact supporting cavities, break-away wall means between at least some of the cavities of opposing rows to provide for forming modules of contact supporting cavities including at least one cavity from each row, supporting wall means between each opposing cavity of each said set thereof, and wherein said break-way wall means are located between adjacent cavities in each row.

* * * * *